US010502016B2

(12) United States Patent
Keat et al.

(10) Patent No.: US 10,502,016 B2
(45) Date of Patent: Dec. 10, 2019

(54) HANGER LANDING PIN INDICATOR

(71) Applicant: Cameron International Corporation, Houston, TX (US)

(72) Inventors: Lim Haw Keat, Singapore (SG); Lai Choon Keat, Singapore (SG); Huang Xian Yi, Singapore (SG); Hee Boon Hao, Singapore (SG); Tan Su Tuan, Singapore (SG)

(73) Assignee: Cameron International Corporation, Houston, TX (US)

( * ) Notice: Subject to any disclaimer, the term of this patent is extended or adjusted under 35 U.S.C. 154(b) by 284 days.

(21) Appl. No.: 15/495,968

(22) Filed: Apr. 24, 2017

(65) Prior Publication Data

US 2018/0306022 A1 Oct. 25, 2018

(51) Int. Cl.
*E21B 33/04* (2006.01)

(52) U.S. Cl.
CPC ..... *E21B 33/0422* (2013.01)

(58) Field of Classification Search
CPC ..... E21B 33/03; E21B 33/037; E21B 33/038; E21B 33/04; E21B 33/0415; E21B 33/0422; E21B 33/043
See application file for complete search history.

(56) References Cited

U.S. PATENT DOCUMENTS

| | | | | |
|---|---|---|---|---|
| 4,923,006 | A | 5/1990 | Hartmann et al. | |
| 6,470,971 | B1 | 10/2002 | Bridges | |
| 2010/0326674 | A1 | 12/2010 | Nguyen et al. | |
| 2011/0024108 | A1* | 2/2011 | Guidry | E21B 33/04 166/250.01 |
| 2012/0018171 | A1* | 1/2012 | Robottom | E21B 33/04 166/379 |
| 2016/0102512 | A1 | 4/2016 | Nguyen | |
| 2016/0319657 | A1 | 11/2016 | Szpunar et al. | |
| 2017/0167218 | A1* | 6/2017 | Cheah | E21B 23/02 |
| 2018/0003002 | A1* | 1/2018 | Bowen, Jr. | E21B 34/02 |

OTHER PUBLICATIONS

PCT Search Report and Written Opinion for PCT/US2018/028213 dated Jul. 31, 2018; 16 pages.

* cited by examiner

*Primary Examiner* — David Carroll
(74) *Attorney, Agent, or Firm* — Fletcher Yoder, P.C.

(57) ABSTRACT

A system includes an annular wellhead housing and an indicator assembly. The annular wellhead housing includes a shoulder and a first passage extending radially through the wellhead housing from an exterior surface of the wellhead housing to an interior surface of the wellhead housing. The indicator assembly is configured to extend through the passage, wherein the indicator assembly, when actuated, is configured to indicate whether a hanger disposed within the wellhead housing has landed on the shoulder.

17 Claims, 6 Drawing Sheets

HANGER LANDING PIN INDICATOR

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations. Hangers (e.g., tubing hangers or casing hangers) may be used to support sections or strings of casing or tubing within a wellhead assembly. Hangers are typically installed by a tool by landing the hanger on an intended shoulder. It may be difficult to determine whether an installed hanger has landed on intended the shoulder. Unfortunately, if the well hanger has not landed on the desired shoulder and the well is cemented, it can be expensive and time consuming to correct.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed embodiments include techniques for determining whether a hanger has landed on an intended shoulder within a wellhead assembly. The hanger may be installed in the wellhead assembly by landing the hanger on the intended shoulder using a hanger running tool. During installation, the hanger may get caught on various features or surfaces within the wellhead assembly before reaching the shoulder. If the well is cemented with the hanger axially offset from the shoulder, correcting the position of the hanger may result in a great expenditure of time and resources. An indicator assembly mounted to a port (e.g., an existing test port) on an exterior surface of the wellhead assembly may allow an operator to easily determine whether the hanger has landed on the shoulder before cementing. The indicator assembly includes a spring-loaded indicator pin, which an operator may press radially inward. Dependent on the position of the pin when it hits a component within the wellhead assembly, the operator may determine whether or not the hanger has landed on the intended shoulder.

Figure 1:
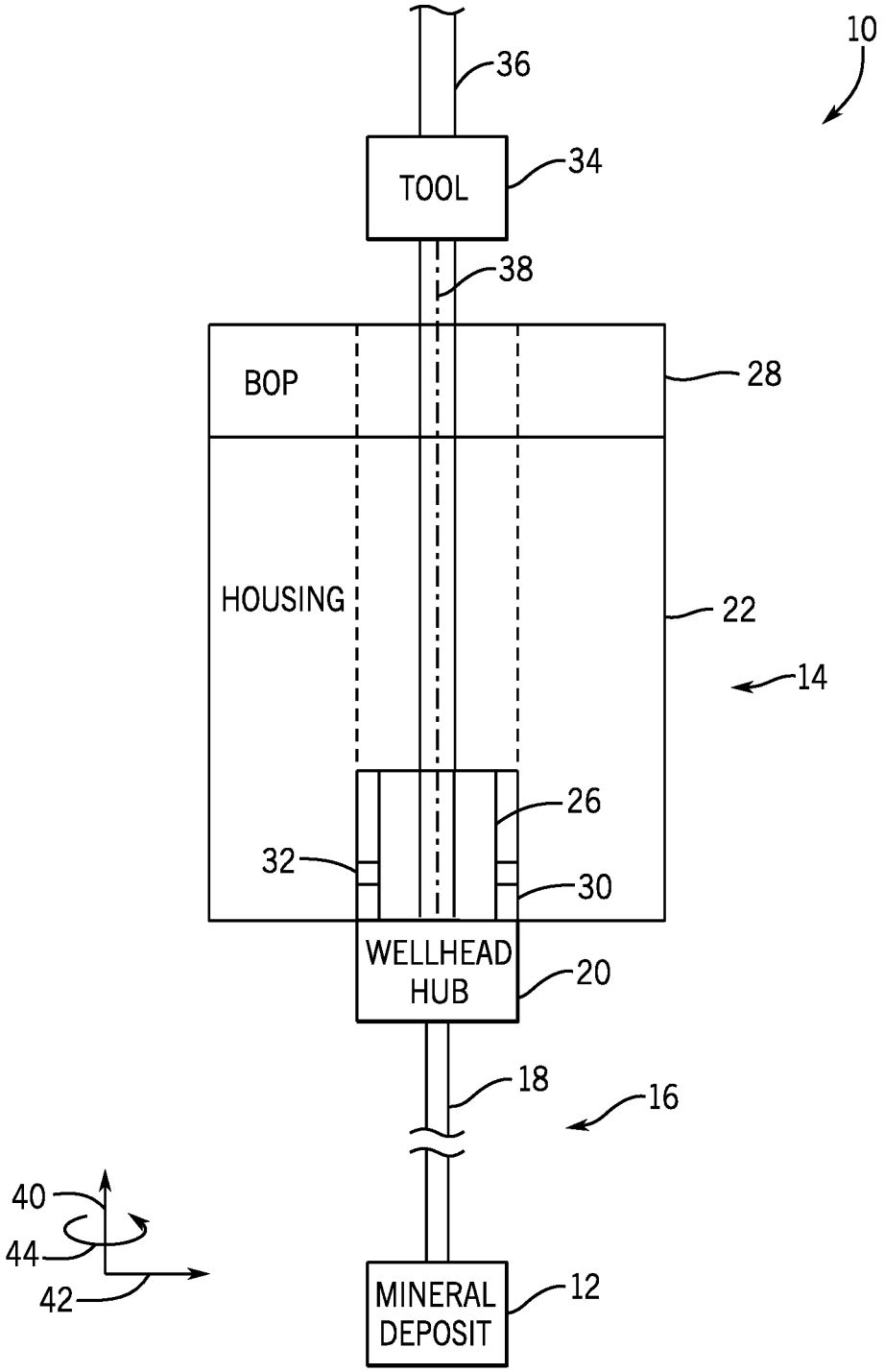
FIG. 1 is a schematic of an embodiment of a mineral extraction system wellhead assembly.

FIG. 1 is a schematic of an exemplary mineral extraction system 10 configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the reservoir 12 to a wellhead hub 20 located at or near the surface.

The illustrated wellhead hub 20, which may be a large diameter hub, acts as an early junction between the well 16 and the equipment located above the well. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead assembly 14 generally includes a series of devices and components that control and regulate activities and conditions associated with the well 16. For example, the wellhead assembly 14 may provide for routing the flow of produced minerals from the mineral deposit 12 and the well bore 18, provide for regulating pressure in the well 16, and provide for the injection of chemicals into the well bore 18 (down-hole). In the illustrated embodiment, the wellhead assembly 14 includes a wellhead housing 22, a hanger 26 (e.g., a tubing hanger or a casing hanger), and a blowout preventer (BOP) 28.

In operation, the wellhead assembly 14 enables completion and workover procedures, such as tool insertion into the well 16 for installation and removal of various components (e.g., hangers, shoulders, etc.). Further, minerals extracted from the well 16 (e.g., oil and natural gas) may be regulated and routed via the wellhead assembly 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the wellhead housing 22 defines a bore 30 that enables fluid communication between the wellhead assembly 14 and the well 16. Thus, the housing bore 30 may provide access to the well bore 18 for various completion and workover procedures, such as emplacing tools or components within the wellhead housing 22. To emplace the components, a shoulder 32 (e.g., an annular shoulder) provides a temporary or permanent landing surface that can support pieces of equipment (e.g., hangers 26). For example, the illustrated embodiment of the extraction system 10 includes a tool 34 suspended from a drill string 36. In certain embodiments, the tool 34 may include a running tool (e.g., a hanger running tool) that is lowered (e.g., run) to the well 16, the wellhead 14, and the like. The hanger 26 may be installed on the shoulder 32 and used to support sections of casing or tubing within the wellhead assembly 14.

For clarity, an axis 38 (e.g., a central longitudinal axis) is shown extending through the wellhead assembly 14. Further, a coordinate system including an axial direction 40, a radial direction 42, and a circumferential direction 44 is shown in FIG. 1. Reference may be made to the coordinate system to communicate spatial relationships between the various components.

It may be difficult to determine whether an installed hanger 26 has landed on the shoulder 32. Unfortunately, if the hanger 26 has not landed on the desired shoulder 32 and the well 16 is cemented properly and completely, it can be expensive and time consuming to correct the placement of the hanger 26. By coupling an indicator assembly having an indicator pin to a port (e.g., an existing test port) of the wellhead housing 22, an operator may determine whether the hanger 26 has properly and completely landed on the intended shoulder 32 based upon how far the indicator pin moves when depressed.

Figure 2:
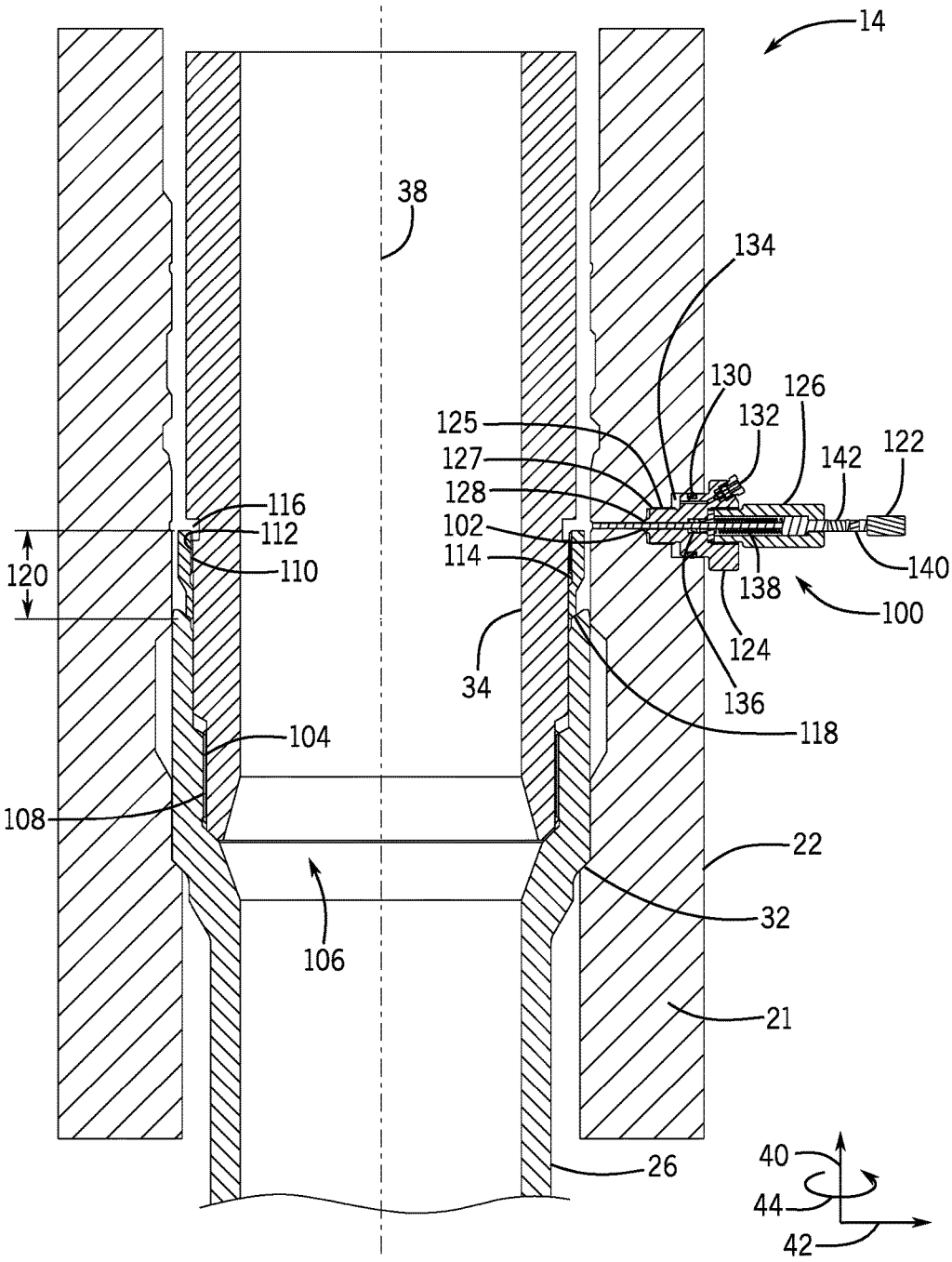
FIG. 2 is a side, section view of an embodiment of the wellhead assembly shown in FIG. 1 with an embodiment of an indicator assembly coupled to an existing test port of a wellhead housing.

FIG. 2 is a side, section view of an embodiment of the wellhead assembly 14 shown in FIG. 1 with an embodiment of an indicator assembly 100 coupled to a port 102 (e.g., an existing test port) of the wellhead housing 22. For example, the port 102 is a side port or radial port extending radially through a sidewall 21 (e.g., annular wall) of the wellhead housing 22. As illustrated in FIG. 2, the hanger running tool 34 may include a first exterior threaded surface 104 (e.g., male threaded annular portion) at an axial end 106 of the hanger running tool 34, which may interface with a threaded interior surface 108 (e.g., female threaded annular portion) of the hanger 26 to couple the hanger 26 to the hanger running tool 34. In other embodiments, the hanger running tool 34 may couple to the hanger 26 via other techniques (e.g., pins, J-slots, set screws, lock rings, radial locking dogs, etc.). The hanger running tool 34 may include a second exterior threaded surface 110 (e.g., male threaded annular portion) axially offset from the first threaded exterior surface 104 and configured to interface with a threaded interior surface 112 (e.g., female threaded annular portion) of an indicator ring 114 to couple the indicator ring 114 to the hanger running tool 34. Further, the hanger running tool 34 may include a recess 116 (e.g., annular recess) axially adjacent to the second exterior threaded surface 110. The indicator ring 114 and the hanger 26 may be coupled to the hanger running tool 34, such that the indicator ring 114 contacts the top surface 118 of the hanger 26. The axial height 120 of the indicator ring 114 may be dimensioned such that when the indicator ring 114 is in contact with a top surface 118 of the hanger 26 and the hanger 26 has landed on the shoulder, the indicator ring 114 does not obscure the recess 116 in the radial direction 42. As will be described in more detail below, the recess 116 may be used to receive an indicator pin 122 to determine whether or not the hanger 26 has landed on the shoulder 32.

An indicator assembly 100 may be coupled to the port 102 (e.g., an existing test port) of the wellhead housing 22. The indicator assembly 100 includes a first and second indicator housings 124, 126 (e.g., annular housings or bodies), which may couple to one another via a threaded interface (shown and described in more detail with regard to FIG. 3). The first indicator housing 124 may include a threaded exterior surface 125 (e.g., male threaded annular portion), which interfaces with a threaded interior surface 127 (e.g., female threaded annular portion) of the test port 102 of the wellhead housing 22 to couple the first indicator housing 124 to the test port 102 of the wellhead housing 22. The first indicator housing 124 includes a tapered annular surface 128 (e.g., a conical surface) and an annular seal 130 (e.g., o-ring), which form respective seals between the first indicator housing 124 and the wellhead housing 22 of the wellhead assembly 14 when the indicator assembly 100 is installed in the test port 102 of the wellhead housing 22. The first indicator housing 124 may also include a pressure test port 132 (e.g., seal test port), which may be used to determine whether the indicator assembly 100 is installed and properly sealed in the test port 102 of the wellhead housing 22. For example, a pressure may be applied via the pressure test port 132. If the indicator assembly 100 is properly installed, seals will be formed between the first indicator housing 124 and the wellhead housing 22 such that a pressure applied via the pressure test port 132 will pressurize volume 134, which is in fluid communication with the test port 132. If the volume 134 holds the pressure applied via the pressure test port 132, the operator will know that the indicator assembly 100 is properly installed and sealed. If the volume 134 does not hold the pressure applied via the pressure test port 132, the operator will know that the indicator assembly 100 is not properly installed, remove the indicator assembly 100, and attempt installation again.

Disposed between the first indicator housing 124 and the second indicator housing 126 is an annular seal 136 through which the indicator pin 122 extends. A spring 138 may be disposed about the indicator pin 122 and within the second indicator housing 126 and configured to bias the indicator pin 122 radially outward (e.g., radial direction 42). The indicator pin 122 includes a positive band or indicator 140 (e.g., annular ring or indicator) and a negative band or indicator 142 (e.g., annular ring or indicator). The bands 140, 142 may be integral or removable. The bands 140, 142 may be achieved by knurling, anodizing, painting, bead blasting, etching, or some other technique that makes the bands 140, 142 visible to an operator. To determine whether or not the hanger 26 has landed on the shoulder 32, the operator depresses the indicator pin 122 radially inward until it contacts an interior component of the wellhead assembly 14. If the hanger 26 has landed on the shoulder 32, the indicator pin 122 will extend over the indicator ring 114 and into the recess 116, such that only the positive band 140 is visible (e.g., the negative band is obscured by the second indicator housing 126). Thus, the positive band or indicator 140 when visible without the negative band or indicator 142 indicates proper and complete landing of the hanger 26 on the shoulder 32. If the hanger 26 has not landed on the shoulder 32, the indicator pin 122 will contact the indicator ring or the hanger 26 and the negative band 142 will be visible to the operator. Thus, the negative band or indicator (when visible) indicates improper or incomplete landing of the hanger 26 on the shoulder 32. The operator may then try to land the hanger 26 on the shoulder 32 again.

Figure 3:
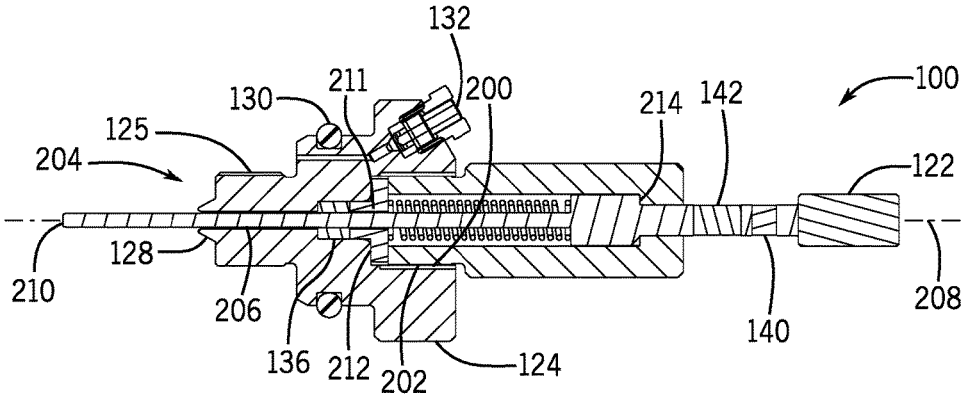
FIG. 3 is a side, section view of an embodiment of the indicator assembly shown in FIG. 2.

FIG. 3 is a side, section view of an embodiment of the indicator assembly 100 shown in FIG. 2. As shown, the first indicator housing 124 includes an interior threaded surface 200 (e.g., female threaded annular portion) that interfaces with an exterior threaded surface 202 (e.g., male threaded annular portion) of the second indicator housing 126 to couple the first indicator housing 124 to the second indicator housing 126. As previously described, the first indicator housing 124 includes a conical surface 124 at an axial end 204 of the first indicator housing 124 and a threaded exterior surface 125 (e.g., male threaded annular portion) to interface with the test port 102 of the wellhead housing 22 (see FIG. 2). The first indicator housing 124 also includes a passage 206 (e.g., central bore) extending along an axis 208 of the indicator assembly 100 through which the indicator pin 122 extends, such that a tip 210 of the indicator pin 122 protrudes out of the first indicator housing 124.

As previously described, the first indicator housing 124 also includes the annular seal 130, which forms a seal with the wellhead housing 22 and the pressure test port 132 that allows the operator to confirm that the indicator assembly 100 is properly installed in the test port 102 of the wellhead housing 22. As illustrated in the embodiment of the indicator assembly shown in FIG. 3, a pin guide 212 (e.g., annular guide with guide bore 211) may be disposed between the first indicator housing 124 and the second indicator housing 126 adjacent the annular seal 136. The pin guide 212 may be a bushing made of low friction material, such as nylon, plastic, or some other material. The indicator pin 122 may extend through the second indicator housing 126, the guide bore 211 in the pin guide 212, the annular seal 136, and the first indicator housing 124 into the wellhead assembly 14 to determine whether the hanger 26 has landed on the shoulder 32. The spring 138 may be disposed about the indicator pin 122, within the second indicator housing 126, to bias the indicator pin 122 radially outward from the wellhead assembly 14. As shown, the indicator pin 122 may include a shoulder 214 (annular surface) to provide a stop against the second indicator housing 126 against the biasing force of the spring 138. As previously described, the operator depresses the indicator pin 122 radially inward until the tip 210 of the indicator pin 122 contacts a component of the wellhead assembly 14 to determine whether the hanger 26 has landed on the shoulder 32. If the negative band 142 is visible when the indicator pin 122 is depressed, the hanger 26 has not properly landed on the shoulder 32. If only the positive band 140 is visible when the indicator pin 122 is depressed, the hanger 26 has properly landed on the shoulder 32.

Figure 4:
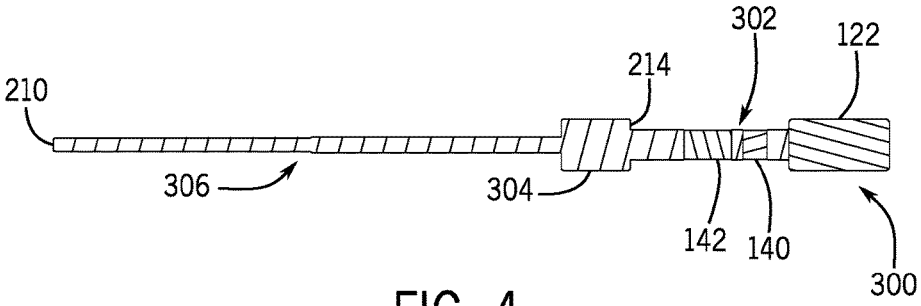
FIG. 4 is a side, section view of an indicator pin of the indicator assembly shown in FIGS. 2 and 3.
Figure 5:
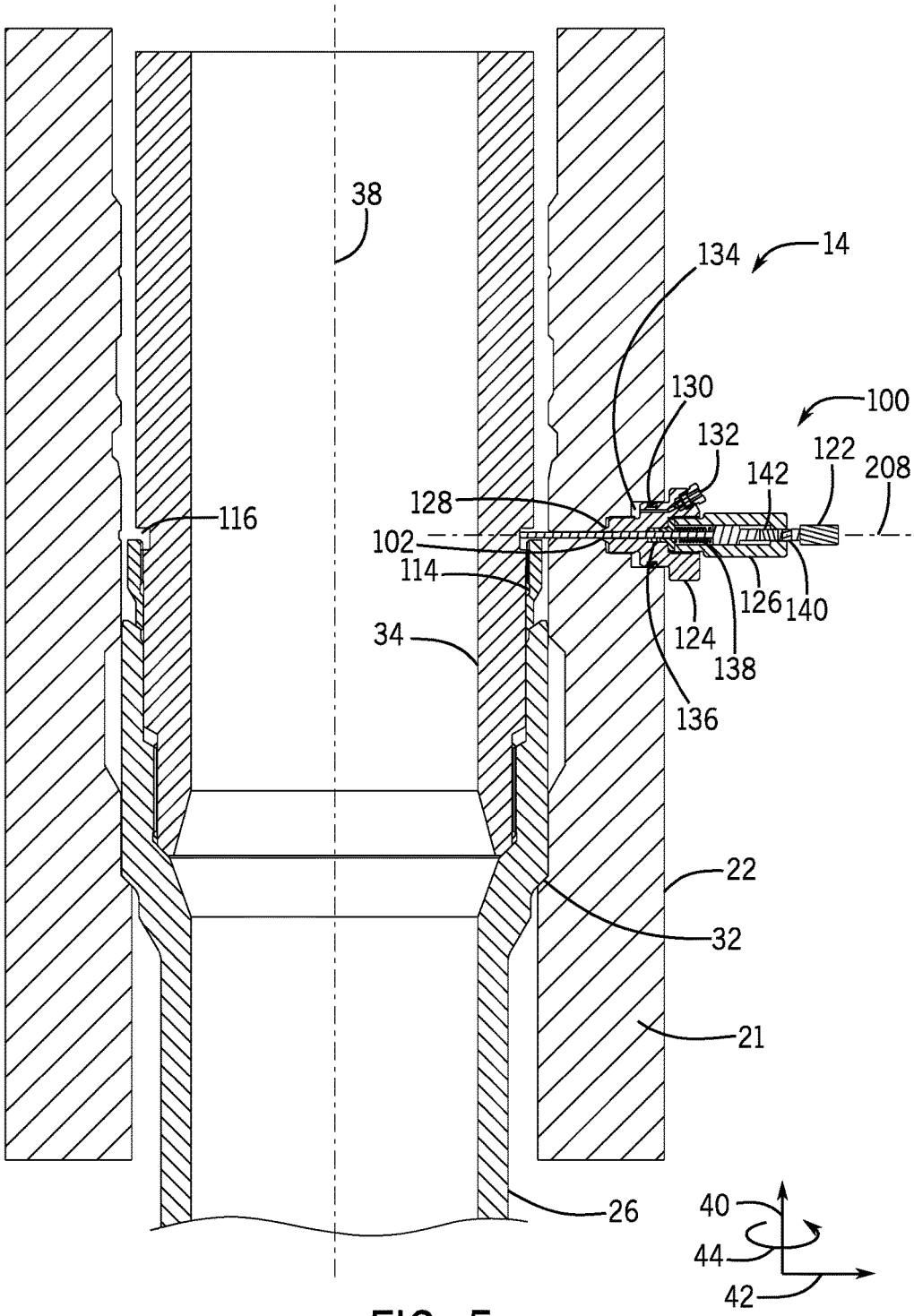
FIG. 5 is a side, section view of the wellhead assembly of FIG. 2 in which a hanger has landed on a shoulder and the indicator pin is depressed, leaving a positive band visible to an operator.
Figure 6:
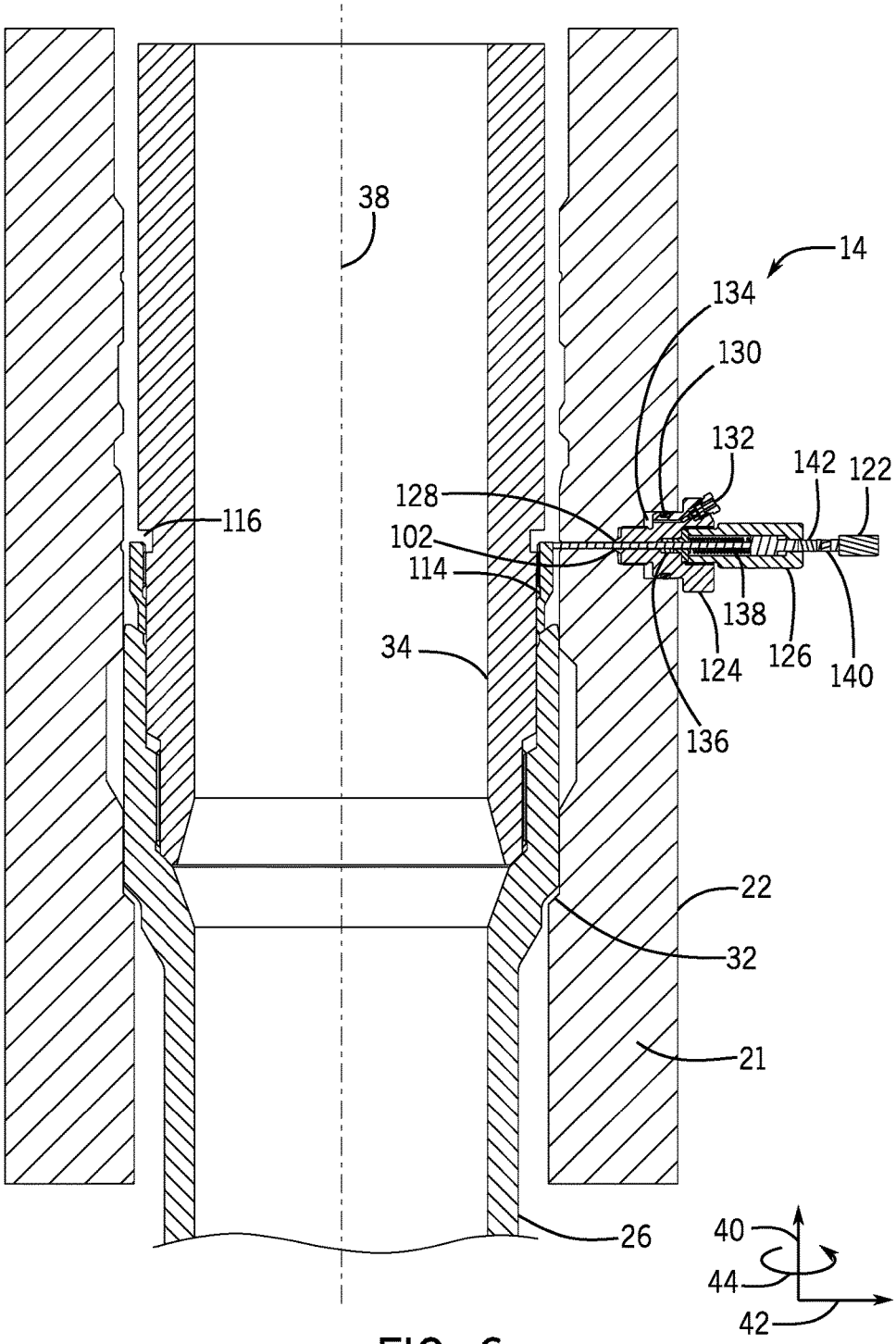
FIG. 6 is a side, section view of the wellhead assembly of FIG. 2 in which the hanger has not landed on the shoulder and the indicator pin is depressed, leaving both the positive band and a negative band visible to the operator.

FIG. 4 is a side, section view of the indicator pin 122 shown in FIGS. 2 and 3. As illustrated, the indicator pin 122 includes an end portion 300 (e.g., user grip portion) to which the operator applies a force to depress the indicator pin 122. Adjacent the end portion 300 is a band portion 302, which includes the positive band 140 and the negative band, adjacent to one another. As previously discussed, the bands may be a different texture (e.g., knurling, texturing, etc.) than the indicator pin 122, a different color (e.g., paint, anodization, etc.) than the indicator pin 122, or have a different finish (e.g., matte, gloss) than the indicator pin 122, some combination thereof, or be otherwise visually distinct from the rest of the indicator pin 122 from the operator's perspective. In other embodiments, the positive band 140 and the negative band 142 may include symbols or text, such as a plus and minus symbol, or colors. In other embodiments, the positive and negative bands 140, 142 may be removable. Adjacent the band portion 302 along the length of the indicator pin 122 is a stopper portion 304 (e.g., annular stop), which includes the shoulder 214. Extending from the stopper portion 304 to the tip 210 is the pin body 306 of the indicator pin 122. As previously discussed, the indicator pin 122 may be dimensioned such that when the hanger 26 has landed on the shoulder 32 and the indicator pin 122 is depressed, the tip 210 extends into the recess 116 of the hanger running tool 34 and only the positive band 140 is visible to the operator (e.g., the negative band is inside the second indicator housing 126). Correspondingly, when the hanger 26 has not landed on the shoulder 32 and the indicator pin 122 is depressed, the tip 210 contacts the indicator ring 114 or the hanger 26 and does not extend into the recess 116, such that both the positive band 140 and the negative band 142 are visible from outside the wellhead housing 22. FIGS. 5 and 6 illustrate depression of the indicator pin 122 when the hanger 26 has landed on the shoulder 32 (FIG. 5) and when the hanger 26 has not landed on the shoulder 32 (FIG. 6).

FIG. 5 is a side, section view of the wellhead assembly 14 in which the hanger 26 has landed on the shoulder 32, and the indicator pin 122 is depressed, leaving only the positive band 140 visible to the operator. As illustrated, the indicator ring 114 is sized such that when the indicator ring 114 and the hanger 26 are coupled to the hanger running tool 34 and the hanger 26 properly and completely lands on the shoulder 32, the indicator ring 114 lies axially offset from the indicator pin 122 such that when the indicator pin 122 is depressed, the tip 210 extends in the radial direction 42 into the recess 116. When the indicator pin 122 is depressed and the tip 210 extends into the recess 116, the negative band 142 is hidden by the second indicator housing 126 and only the positive band 140 is visible to the operator from outside the wellhead housing 22 (i.e., indicating proper landing of the hanger).

FIG. 6 is a side, section view of the wellhead assembly 14 in which the hanger 26 has not landed on the shoulder 32, and the indicator pin 122 is depressed, leaving both the positive band 140 and the negative band 142 visible to the operator. As illustrated, when the hanger 26 gets caught within the well head housing 22 before landing on the shoulder 32, the indicator ring 114 overlaps with the indicator pin 122 such that the indicator ring 114 obscures the recess 116 from the indicator pin 122. When the indicator pin 122 is depressed, the tip 210 extends in the radial direction 42 until it contacts the indicator ring 114, leaving both the positive band 140 and the negative band 142 visible to the operator from outside the wellhead housing 22 (i.e., indicating improper or incomplete landing of the hanger 26). The operator may then retrieve the hanger 26 and the hanger running tool 34 and attempt to land the hanger 26 on the shoulder 32 again.

Figure 7:
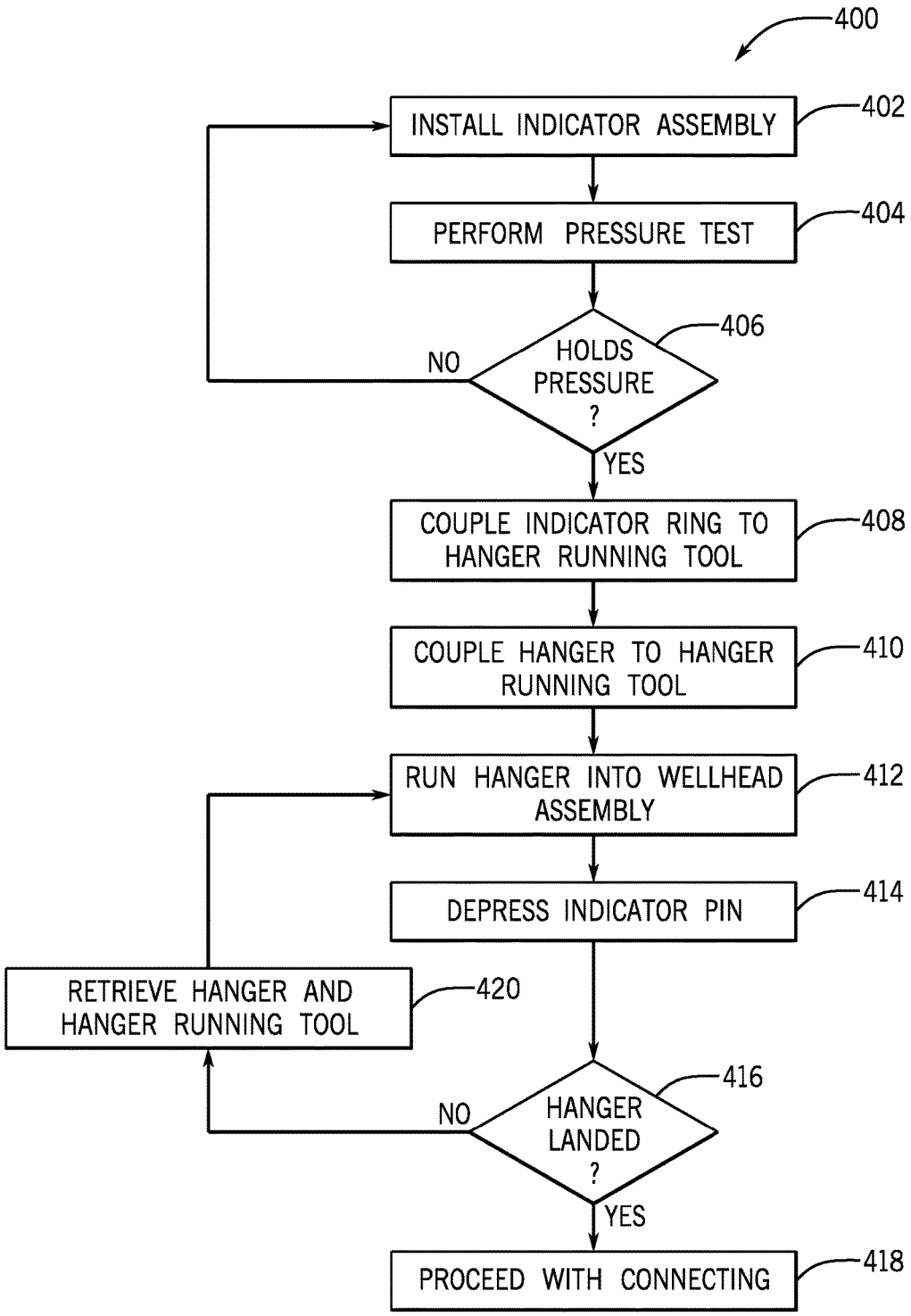
FIG. 7 is a flow chart of an embodiment of a process for installing the indicator assembly and determining whether the hanger has landed on the shoulder 32.

FIG. 7 is a flow chart of an embodiment of a process 400 for installing the indicator assembly 100 and determining whether the hanger 26 has landed on the shoulder 32. In block 402, the indicator assembly 100 is installed in the test port 102 of the wellhead housing 22. As previously described, an exterior threaded surface 125 of the first indicator housing 124 interfaces with the interior threaded surface 127 of the test port 102 of the wellhead housing 22 to hold the indicator assembly 100 in place. As previously discussed, when installed the conical surface 128 and the annular seal 130 each form a seal between the first indicator housing 124 and the test port 102 of the wellhead housing 22.

In block 404, a pressure test is performed to ensure that indicator assembly 100 is properly installed and sealed. For example, a pressure may be applied to the pressure test port 132 of the first indicator housing 124, which is in fluid communication with the volume 134 between the first indicator housing 124 and the wellhead housing 22. If the indicator assembly 100 is properly installed, the conical surface 128 and the annular seal 130 each form a seal between the first indicator housing 124 and the test port 102 of the wellhead housing 22, allowing the volume 134 to hold a pressure. In decision 406, if the volume 134 does not hold pressure, the indicator assembly 100 is removed and installation is attempted again (block 402). If the volume 134 does hold a pressure, the process 400 proceeds.

In block 408, the indicator ring 114 is coupled to the hanger running tool 34. As previously described, the interior threaded surface 112 of the indicator ring 114 interfaces with the second exterior threaded surface 110 of the hanger running tool 34 to couple the indicator ring 114 and the hanger running tool 34 to one another.

In block 410, the hanger 26 is coupled to the hanger running tool 34. As previously discussed, the interior threaded surface 108 of the hanger 26 interfaces with the first exterior threaded surface 104 of the hanger running tool 34 in order to couple the hanger 26 to the hanger running tool 34.

In block 412, the hanger 26 is run into the wellhead assembly 14 using the hanger running tool 34. For example, the hanger running tool 34, to which the hanger 26 is coupled, is extended axially through the wellhead housing 22 of the wellhead assembly 14 toward the shoulder 32 until the hanger 26 can no longer move in the axial direction 40 through the wellhead housing 22.

In block 414, the indicator pin 122 of the indicator assembly 100 is depressed. For example, the operator located outside the wellhead housing 22 may depress the indicator pin 122 radially inward by applying a force to the end portion 300 of the indicator pin 122.

At decision 416, a determination is made whether the hanger 26 has landed on the shoulder 32. When the indicator pin 122 is depressed and both the positive and negative bands 140, 142 remain visible outside of the second indicator housing 126, this is indicative that the hanger 26 has not properly or completely landed on the shoulder 32. In contrast, when the indicator pin 122 is depressed and only the positive band 140 is visible outside of the second indicator housing 126, this is indicative that the hanger 26 has properly and completely landed on the shoulder 32. If the hanger 26 has landed on the shoulder 32, the process proceeds to block 418 and proceeds with cementing operations, or other subsequent processes to set up the well 16.

If the hanger 26 has not landed on the shoulder 32, in block 420, the hanger 26 and the hanger running tool 34 are retrieved and the process returns to block 412 in another attempt to run the hanger 26 and land the hanger 26 on the shoulder 32.

The presently disclosed embodiments include an indicator assembly which is coupled to the exterior of a wellhead housing (e.g., an existing test port) and actuated to indicate whether the hanger has landed on the intended shoulder. If the hanger has not landed on the shoulder, the hanger and hanger running tool may be retrieved and re-run into the wellhead assembly as needed until the hanger has landed on the shoulder. By ensuring that the hanger has landed on the shoulder before cementing the well, instances of the time consuming the costly process of resetting the hanger of a well that has already been cemented may be reduced.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

an annular wellhead housing, comprising:

a shoulder; and a first passage extending radially through the wellhead housing from an exterior surface of the wellhead housing to an interior surface of the wellhead housing; and an annular indicator ring disposed axially adjacent to a hanger, wherein the hanger and the indicator ring are configured to couple to a hanger running tool, wherein the hanger running tool comprises an annular recess;

an indicator assembly configured to extend through the passage, wherein the indicator assembly, when actuated radially inward, is configured to extend into the annular recess of the hanger running tool to indicate that the hanger disposed within the wellhead housing has landed on the shoulder.

2. The system of claim 1, wherein the indicator assembly is configured to contact the indicator ring when the indicator assembly is actuated and the hanger has not landed on the shoulder.

3. The system of claim 1, wherein the first passage comprises an existing test port.

4. The system of claim 1, wherein the indicator assembly comprises:

an annular housing comprising a second passage;

an indicator pin extending through the second passage of the annular housing; and a spring configured to bias the indicator pin radially outward;

wherein a tip of the indicator pin is configured to contact the annular recess of the hanger running tool when the indicator pin is depressed radially inward and the hanger has landed on the shoulder, and wherein the indicator pin is configured to contact the indicator ring or the hanger when the indicator pin is depressed radially inward and the hanger has not landed on the shoulder.

5. The system of claim 4, wherein the housing comprises:

a first indicator housing, comprising:

a conical surface configured to form a first seal with the first passage of the wellhead housing;

an exterior threaded surface disposed adjacent to the conical surface and configured to interface with an interior threaded surface of the first passage of the wellhead housing an annular seal disposed adjacent to the exterior threaded surface and configured to form a second seal with the first passage of the wellhead housing;

a pressure test port in fluid communication with a volume disposed between the first indicator housing and the wellhead housing.

6. The system of claim 5, wherein the pressure test port is configured to receive a pressure to determine whether the indicator assembly is properly installed and sealed within the first passage of the wellhead housing.

7. An indicator assembly configured to extend through and couple to a test port of a wellhead housing, the indicator assembly comprising:

an annular housing comprising a passage;

an indicator pin extending through the passage of the annular housing; and a spring configured to bias the indicator pin radially outward;

wherein the indicator assembly, when actuated, is configured to indicate whether a hanger disposed within the wellhead housing has landed on a first shoulder of the wellhead housing, wherein a tip of the indicator pin is configured to contact an annular recess of a hanger running tool when the indicator pin is depressed radially inward and the hanger has landed on the first shoulder, and wherein the indicator pin is configured to contact an indicator ring or the hanger when the indicator pin is depressed radially inward and the hanger has not landed on the first shoulder.

8. The indicator assembly of claim 7, wherein the annular housing comprises:

a first annular indicator housing comprising a first interior threaded surface; and a second annular indicator housing comprising a first exterior threaded surface configured to interface with the first interior threaded surface of the first annular indicator housing to couple the second annular indicator housing to the first annular indicator housing.

9. The indicator assembly of claim 8, wherein the indicator pin comprises:

a positive band;

a negative band; and a stopper portion comprising a second annular shoulder configured to contact the second indicator housing when the spring biases the indicator pin radially outward;

wherein the positive band and the negative band are positioned on the indicator pin such that when the indicator pin is depressed radially inward and the hanger has landed on the first shoulder, the negative band is obscured from view by the second indicator housing, and when the indicator pin is depressed radially inward and the hanger has not landed on the first shoulder, the negative band is not obscured by the second indicator housing.

10. The indicator assembly of claim 9, wherein the positive band and the negative band are visible to a user due to color, texture, text, graphics, or finish, or a combination thereof.

11. The indicator assembly of claim 7, wherein the first indicator housing comprises:

a conical surface configured to form a first seal with the test port of the wellhead housing;

a second exterior threaded surface disposed adjacent to the conical surface and configured to interface with a second interior threaded surface of the test port of the wellhead housing;

an annular seal disposed adjacent to the exterior threaded surface and configured to form a second seal with the test port of the wellhead housing;

a pressure test port in fluid communication with a volume disposed between the first indicator housing and the wellhead housing.

12. The indicator assembly of claim 11, wherein a pressure is applied to the pressure test port to determine whether the indicator assembly is properly installed within the first passage of the wellhead housing.

13. A method, comprising:

coupling an indicator assembly to a wellhead housing of a wellhead assembly, wherein the indicator assembly comprises an indicator pin configured to extend radially through the wellhead housing, wherein the wellhead housing comprises an annular shoulder;

coupling an indicator ring to a hanger running tool;

coupling a hanger to the hanger running tool, wherein the hanger running tool comprises an annular recess configured to receive a portion of the indicator pin when the indicator assembly is actuated and the hanger has landed on the shoulder, and wherein the indicator pin is configured to contact the indicator ring when the indicator assembly is actuated and the hanger has not landed on the shoulder;

running the hanger and the hanger running tool into the wellhead housing;

depressing the indicator pin radially inward;

determining whether the hanger has landed on the shoulder based on how far the indicator pin is depressed before contacting a surface of the wellhead assembly.

14. The method of claim 13, comprising:

applying a pressure to a pressure test port of the indicator assembly; and removing and reinstalling the indicator assembly if the pressure test port does not hold the applied pressure.

15. The method of claim 13, comprising retrieving and re-running the hanger and the hanger running tool if the hanger has not landed on the shoulder.

16. The method of claim 13, wherein the indicator assembly is coupled to an existing test port of the wellhead housing.

17. The method of claim 13, wherein the indicator assembly comprises:

an annular housing comprising a passage;

the indicator pin extending through the passage of the annular housing; and a spring configured to bias the indicator pin radially outward.

* * * * *